US006837970B2

(12) United States Patent
Ko et al.

(10) Patent No.: US 6,837,970 B2
(45) Date of Patent: Jan. 4, 2005

(54) WOOD PULP FIBER MORPHOLOGY MODIFICATIONS THROUGH THERMAL DRYING

(75) Inventors: Young Chan Ko, Neenah, WI (US); Sheng-Hsin Hu, Appleton, WI (US); Kambiz B. Makoui, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 90 days.

(21) Appl. No.: 10/025,213

(22) Filed: Dec. 18, 2001

(65) Prior Publication Data

US 2003/0111193 A1 Jun. 19, 2003

(51) Int. Cl.[7] ..... D21H 15/04

(52) U.S. Cl. ..... 162/9; 162/100; 428/369; 604/358; 604/374

(58) Field of Search ..... 162/9, 157.6, 146, 162/100; 428/369; 604/358, 374

(56) References Cited

U.S. PATENT DOCUMENTS

| | | | |
|---|---|---|---|
| 3,497,418 A | | 2/1970 | Thale et al. |
| 3,556,931 A | | 1/1971 | Champaigne |
| 3,770,575 A | | 11/1973 | Ball |
| 3,987,968 A | | 10/1976 | Moore et al. |
| 4,183,145 A | | 1/1980 | Piterskikh et al. |
| 4,481,076 A | | 11/1984 | Herrick |
| 4,657,767 A | | 4/1987 | Meade |
| 4,888,093 A | | 12/1989 | Dean et al. |
| 4,898,642 A | | 2/1990 | Moore et al. |
| 5,015,332 A | | 5/1991 | Iwaya et al. |
| 5,100,509 A | | 3/1992 | Pisecky et al. |
| 5,137,537 A | | 8/1992 | Herron et al. |
| 5,190,563 A | | 3/1993 | Herron et al. |
| 5,217,445 A | | 6/1993 | Young et al. |
| 5,223,088 A | | 6/1993 | Hansen |
| 5,435,822 A | | 7/1995 | Blouin |
| 5,484,896 A | * | 1/1996 | Naieni et al. |
| 5,519,948 A | | 5/1996 | Raehse et al. |
| 5,537,759 A | | 7/1996 | Raehse et al. |
| 5,544,427 A | | 8/1996 | Raehse et al. |
| 5,549,791 A | | 8/1996 | Herron et al. |
| 5,562,740 A | | 10/1996 | Cook et al. |
| 5,611,840 A | | 3/1997 | Kraus et al. |
| 5,632,100 A | | 5/1997 | Hansen |
| 5,632,102 A | | 5/1997 | Luy et al. |
| 5,672,249 A | | 9/1997 | Vinson et al. |
| 5,685,089 A | | 11/1997 | Getler et al. |
| 5,695,614 A | | 12/1997 | Hording et al. |
| 5,700,352 A | | 12/1997 | Vinson et al. |
| 5,759,346 A | | 6/1998 | Vinson |
| 5,830,317 A | | 11/1998 | Vinson et al. |
| 5,834,095 A | | 11/1998 | Dutkiewicz et al. |
| 5,849,862 A | | 12/1998 | Davies et al. |
| 5,958,185 A | | 9/1999 | Vinson et al. |
| 6,237,247 B1 | | 5/2001 | Van Den Meersche |

FOREIGN PATENT DOCUMENTS

| | | |
|---|---|---|
| EP | O 096 460 A2 | 12/1983 |
| EP | 252 650 | 1/1988 |
| JP | 3-267200 | 11/1991 |
| WO | WO 94/23121 | 10/1994 |
| WO | 97/00354 | 3/1997 |

OTHER PUBLICATIONS

A.M. Scallan, *The Structure of the Cell Wall of Wood—A Consequence of Anisotropic Inter–Microfibrillar Bonding*?, Wood Science, vol. 6, No. 3, p. 266, 267, 269 & 271 (Jan. 1974).

Alfred J. Stamm and William E. Smith *Laminar Sorption and Swelling Theory for Wood and Cellulose*, Wood Science and Technology, vol. 3, p. 301–323 (1969).

A. J. Kerr and D. A. I. Goring, *The Ultrastructural Arrangement of the Wood Cell Wall*, Cellulose Chem. Technol., 9, p. 563–573 (1975).

G. Graham Allan and Young C. Ko, *The Microporosity of Pubp. The Forces Influencing the Intra and Inter–Fiber Pore Structure and Pore Size Distribution in Pulp and Paper*, Cellulose Chem. Technol., 29, p. 479–485 (1995).

D. A. I. Goring, R. Vuong, C. Gancet and H. Chanzy, *The Flatness of Lignosulfonate Macromolecules as Demonstrated by Electron Microscopy*, Journal of Applied Polymer Science, vol. 24, p. 931–936 (1979).

B. D. Favis and D.A.I. Goring, *A Model for the Leaching of Lignin Macromolecules from Pulp Fibers*, Journal of Pulp and Paper Science, p. 139–143 (Sep. 1984).

D. A. I. Goring, *A Speculative Picture of the Delignification Process*, Cellulose Chemistry and Technology, p. 273–277.

J. E. Stone and A. M. Scallan, *A Study of Cell Wall Structure by Nitrogen Adsorption*, Pulp Paper Magazine, Canada, T407 (1965).

Leonard Haas, *Iggesund Pioneers Flash Drying of Fully Bleached Kraft Pulp*, Progress in Pulping (4 pages) (1971).

H–E. Engstöm, O. B. Hovstad and L. Ivnäs, *Flash Drying System for Pulp–Design Factors, reprinted from* Pulp and Paper, Part 1, (4 pages) Aug. 21 and Aug. 28 (1967).

H–E. Engström, O. B. Hovstad and L. Ivnäs, *Flash Dried Pulp–Some Revealing Facts on Strength and Beating Properties, reprinted from* Pulp and Paper, Part 2, (4 pages) (1967).

* cited by examiner

*Primary Examiner*—Peter Chin
(74) *Attorney, Agent, or Firm*—Pauley Petersen & Erickson

(57) ABSTRACT

A method of modifying a two-dimensional, flat fiber morphology of a never-been-dried wood pulp into a three-dimensional twisted fiber morphology without the aid of a chemical cross-linker. The method includes the steps of treating a never-been-dried wood pulp fiber slurry with a drying aid and thermally drying the wood pulp fiber slurry. The method may alternatively, or additionally, include the steps of spray drying a wood pulp fiber slurry and/or a slurry of a hydrophilic material, and flash drying the spray dried wood pulp fiber slurry and/or slurry of hydrophilic material.

20 Claims, 1 Drawing Sheet

20

WOOD PULP FIBER MORPHOLOGY MODIFICATIONS THROUGH THERMAL DRYING

BACKGROUND OF THE INVENTION

The present invention is directed to methods of modifying wood pulp fiber morphology to produce three-dimensional coiled fibers without the aid of a chemical cross-linker.

Wood pulp is commonly used to make paper as well as absorbent articles. When wood pulp fibers are flat, or roughly two-dimensional, the fibers lack absorbency and softness compared to wood pulp fibers that are coiled, or three-dimensional.

Never-been-dried wood pulp has many fine pores within the cell walls in a multi-lamellar fashion. The pores are commonly referred to as intra-fiber capillaries, in contrast to inter-fiber capillaries that are formed between individual fibers. The intra-fiber capillaries of a never-been-dried pulp are highly vulnerable to outside forces such as the surface tension of water, electrolytes, mechanical and thermal treatments to name a few. In particular, intra-fiber capillaries are easily collapsed during conventional thermal drying, such as during drum drying.

When the intra-fiber capillaries of a never-been-dried pulp collapse during drying, the width, or diameter, of individual fibers shrinks. As a result, the morphology of once-dried wood pulp tends to be flat and ribbon-like, and the intra-fiber capillaries practically disappear.

If a never-been-dried fiber does not shrink uniformly during drying, its fiber morphology will be quite different from the conventional ribbon-like fiber morphology. Such fibers that shrink non-uniformly are likely to be coiled or twisted. The degree of coils or twists per individual fiber depends on the number of intra-fiber capillaries within the wood pulp and the degree of non-uniform shrinkage of fiber diameters along their fiber axes, i.e., perpendicular to the fiber diameter direction.

Flash drying is a well-known thermal drying method used to dry various materials, such as wood pulps, gypsum, and native starch. In flash drying, a wet material is exposed to a very hot drying air (or gas) environment without any constraints at a very short time, for example, a few seconds. These drying conditions of a flash dryer for wood pulp fibers can cause fibers to be in a non-equilibrium state during drying so as to make the fibers shrink non-uniformly. This results in fibers having coiled structures. In addition, such a short drying time provides very little opportunity for the pores within the fibers to collapse, thereby resulting in enhanced absorptive properties for the fibers.

Unfortunately, however, flash drying conditions also have a tendency to cause fibers to be entangled, thus forming a so-called fish eye (or fiber bundles, nodules), not just causing the fibers to be twisted. Consequently, a typical commercial flash dryer has been designed to minimize the fiber entanglements and twists.

Curly, twisted cellulose fibers can be produced by permanently interlocking the intra-fiber capillaries with a chemical cross-linker prior to flash drying. The use of a chemical cross-linker is unfavorable for a number of reasons. In particular, the use of a chemical cross-linker involves safety concerns since chemical cross-linkers are generally hazardous and harmful. Therefore, the use of a chemical cross-linker requires a thorough washing of un-reacted chemical cross-linker for safety. Also, the use of a chemical cross-linker is likely to cause interlocking between fibers that would be difficult to be fiberized into individual fibers for a product application. Potential damage to the fibers may occur during the defibration stage due to interlocking of the fibers. It can be difficult to form an absorbent product due to such interlocking of fibers. Furthermore, the use of a chemical cross-linker is not very economical due to the complexity of handling such a chemical cross-linker.

More importantly, with respect to the present invention, such permanently interlocking intra-fiber capillary structures tend to make the fibers stiffened and destroy all the useful capillaries as fluid channels.

In order to obtain a very short drying time during a thermal drying process such as flash drying, it is necessary to fluff pulp so that the largest possible pulp surface is exposed to the hot drying air. In particular, the wet pulp must be thoroughly fluffed as individual fibers prior to flash drying, otherwise dried fibers come out as fiber bundles, or entanglements. Once fibers are entangled during flash drying, the fibers are very difficult to be disentangled into individual fibers for subsequent uses. Thus, the fluffing operation is the key to a successful flash drying system.

To use a feed of wood pulp and/or various other hydrophilic materials for flash drying, the water in the wet pulp should be removed substantially. This water removal is conventionally achieved by mechanical means such as a filter press or centrifugation. At such a high consistency level, it is very difficult to fluff the pulp into individual fibers. To alleviate this problem, a mechanical device such as a disintegrator is commonly employed after the mechanical de-watering step in the flash drying system.

It is therefore an object of the present invention to provide a method of modifying wood pulp fiber morphology to produce three-dimensional coiled fibers without the aid of a chemical cross-linker.

It is another object of the present invention to maintain the original intra-capillary structure of wood pulp fiber during a rapid thermal drying process to utilize the structure of the wood pulp fiber as fluid channels.

It is yet another object of the present invention to use a drying aid, such as a surfactant, to maximize the extent of twisting and to help maintain the porous structures of wood pulp fibers during a rapid thermal drying process.

It is still another object of the present invention to provide an alternative method of fluffing wet pulp into individual fibers as opposed to using conventional mechanical devices.

SUMMARY OF THE INVENTION

The present invention is generally directed to methods of modifying the two-dimensional, flat, ribbon-like fiber morphology of a typical never-been-dried wood pulp into a three-dimensional, coiled, helical, spiral, twisted fiber morphology. The invention is applicable to wood pulp fibers as well as a slurry of hydrophilic materials such as microcrystalline cellulose, microfibrillated cellulose, or superabsorbent material, or a combination of any of these.

In one embodiment of the invention, the fiber morphology of a typical never-been-dried wood pulp is modified without the aid of a chemical cross-linker. Instead, such modification is achieved using thermal drying technologies with drying aids. More particularly, the degree of non-uniformity of fiber shrinkage inducing the formation of fiber coils is increased when a never-been-dried pulp is thermally dried under an extremely high drying temperature for a very short drying time with drying aids for removing water from the intra-fiber capillaries. A flash dryer can be used to thermally dry the fibers.

The never-been-dried pulp can be treated with a drying aid, and water can then be removed from the pulp up to a consistency level at which the intra-fiber capillaries remain unchanged. As a drying aid, any material, such as a surfactant, that speeds up removing water from the intra-fiber capillaries can be used.

In another embodiment, a never-been-dried wood pulp can be subjected to a refining treatment to create more intra-fiber capillaries. After the fines are removed, the wood pulp fibers can be treated with a drying aid prior to thermal drying, such as flash drying.

In yet another embodiment of the invention, spray drying is carried out to prepare a feed of wood pulp or other hydrophilic materials for subsequent flash drying. It may be very difficult to fluff the wood pulp into individual fibers when the consistency of the wet pulp is about 30% to about 50%, and such consistency is needed to use the feed in a flash dryer. Instead of using a mechanical device, such as a disintegrator, after the mechanical de-watering step in the flash drying system, an alternative method of fluffing the pulp is carried out by drying the pulp slurry, having a consistency ranging from less than 0.1% to about 3% by weight, in a spray dryer until the pulp reaches a desirable consistency for subsequent flash drying. Preparing a pulp feed from a dilute pulp slurry by spray drying in this manner eliminates the mechanical de-watering step and the fluffing system entirely in the flash drying system.

Preparing a pulp of a desirable consistency (around 15% to about 60% by weight) for subsequent flash drying by spray drying should be much more effective in fluffing the pulp into individual fibers than by using conventional mechanical means. The modified pulp fibers are particularly suitable for making paper and absorbent products.

These and other features, aspects, and advantages of the present invention will become better understood with regard to the following description and appended claims.

DETAILED DESCRIPTION OF THE PRESENTLY PREFERRED EMBODIMENTS

Figure 1:
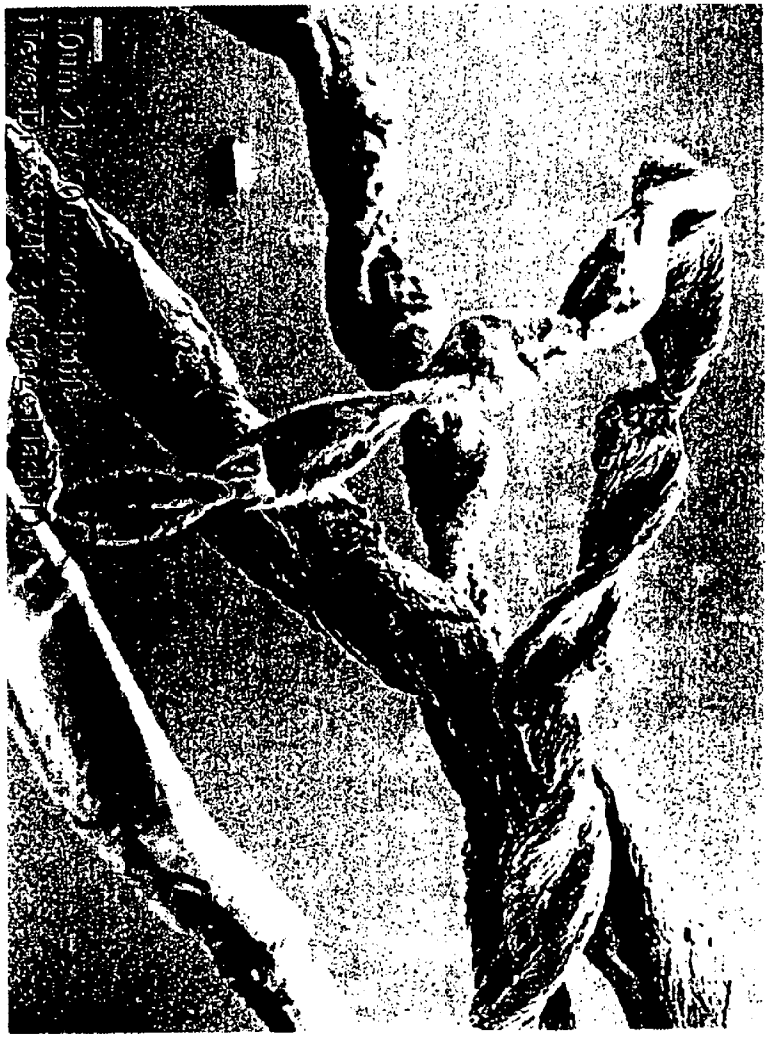
FIG. 1 is a perspective view of a fiber twist.

The present invention is generally directed to methods of modifying wood pulp fiber morphology to produce three-dimensional coiled fibers. Instead of using a chemical cross-linker, the fibers can be modified using thermal drying technologies, such as flash drying, with drying aids. The invention also teaches the use of spray drying in lieu of a mechanical de-watering step and a fluffing system in a flash drying system.

Before describing representative embodiments of the invention, it is useful to define a number of terms for purposes of this application. These definitions are provided to assist the reader of this document.

"Drying aid" refers to any material, such as a surfactant, that speeds up the removal of water from intra-fiber capillaries of a fiber.

"Fiber" or "fibrous" refers to a particulate material wherein the length to diameter ratio of such particulate material is greater than about 10. Conversely, a "nonfiber" or "nonfibrous" material is meant to refer to a particulate material wherein the length to diameter ratio of such particulate material is about 10 or less.

"Fiber twist" refers to the fiber morphology of a coiled or twisted fiber, as shown in FIG. 1.

"Flash dryer" and "flash drying" refer to a thermal drying method in which wet material is exposed to a hot air (or gas) stream at a very short residence time as a means of drying the wet material.

"Fluff" and "fluffing" refer to a state or process in which fibrous agglomerates are separated into individual fibers.

"Hydrophilic" describes fibers or the surfaces of fibers which are wetted by the aqueous liquids in contact with the fibers. The degree of wetting of the materials can, in turn, be described in terms of the contact angles and the surface tensions of the liquids and materials involved. Equipment and techniques suitable for measuring the wettability of particular fiber materials or blends of fiber materials can be provided by a Cahn SFA-222 Surface Force Analyzer System, or a substantially equivalent system. When measured with this system, fibers having contact angles less than 90° are designated "wettable" or hydrophilic, while fibers having contact angles greater than 90° are designated "non-wettable" or hydrophobic.

"Never-been-dried" is a term used to describe fibers that have never been exposed to a drying process, such as thermal drying or forced air drying.

"Refining treatment" refers to treatment of fibers that causes fractures and fibrillations which aid in imparting strength to resulting applications in which the fibers are used.

"Spray dryer" and "spray drying" refer to a method and apparatus for transforming feed from a fluid state to a dried particulate form by spraying the feed into a hot drying medium, typically a hot gas.

"Thermal drying" refers to a process of drying fibers or other material in which heat is used to accelerate the drying.

"Twist count" refers to the number of twist nodes present along a longitudinal axis of a fiber over a certain length of the fiber. Twist count is used to measure the degree to which a fiber is rotated about its longitudinal axis. The term "twist node" refers to a substantially axial rotation of 180 degrees about the longitudinal axis of the fiber, wherein a portion of the fiber (i.e., the "node") appears dark relative to the rest of the fiber when viewed under a microscope with transmitted light because the transmitted light passes through an additional fiber wall due to the above-mentioned rotation.

"Water Retention Value (WRV)" refers to the volume of the intra-capillaries within the fibers. It is conventionally determined according to the following method: A sample of 0.700±0.100 oven-dry gram of the sample is put into a specimen container, with a lid. The total volume in the container is brought up to 100 ml with purified (distilled or deionized) water. Gentle dispersion techniques are applied to the specimen until the nit or clumps of fibers are not present. The dispersed fibers are collected by removing excess water with a filter system under vacuum. The fibers are then placed into a centrifuge tube with a screen and the fibers are centrifuged at a relative centrifuge force of 900 gravities for 30 minutes. When the centrifuge is completed, the tube cap is removed with a dissecting needle to retrieve the fibers from the filter paper in the tube. After taring a weighing dish, the fibers are weighed and the wet weight of the fibers is recorded. The weighing dish is then placed with the fibers in a 105±2 degrees Celsius oven for a minimum of 12 hours. The dried fibers are then weighed. The water retention value (WRV) is calculated using the following equation: $WRV=(W-D)/D$, wherein W is the wet weight of the fibers, and D is the dry weight of the fibers. The WRV is in units of grams of water per gram of dry fiber.

One version of a method possessing features of the present invention includes modifying a two-dimensional, flat, ribbon-like fiber morphology of a never-been-dried wood pulp into a three-dimensional coiled, helical, spiral, twisted fiber morphology without the use of a chemical cross-linker. Instead, a method of the present invention is carried out using a drying aid and thermal drying technologies.

The methods of the invention can be used to modify virtually any type of wood pulp, including but not limited to chemical pulps such as sulfite and sulfate (sometimes called Kraft) pulps, as well as mechanical pulps such as ground wood, thermomechanical pulp and chemithermomechanical pulp. Pulps derived from both deciduous and coniferous trees can be used. Although the invention is directed to the modification of wood pulp fiber morphology, the invention may also be used to modify the morphology of other hydrophilic materials in a slurry. For example, the invention can be used on such hydrophilic materials as microcrystalline cellulose, microfibrillated cellulose, superabsorbent material, or a combination of any of these materials, or any of these materials in combination with wood pulp fibers.

The principle behind the present invention is that a never-been-dried fiber that does not shrink uniformly during drying will have a fiber morphology quite different from conventional ribbon-like fiber morphology. Non-uniformly dried fibers are likely to be coiled or twisted, and the degree of coils or twists per individual fiber depends on the amount of the intra-fiber capillaries of wood pulp and the degree of non-uniform shrinkage of fiber diameters along their fiber axes, i.e., perpendicular to the fiber diameter direction. The degree of non-uniformity of the fiber shrinkage inducing the fiber coils is expected to increase when a never-been-dried pulp is thermally dried under an extremely high drying temperature and a very short drying time with drying aids for removing water from the intra-fiber capillaries.

Suitable thermal drying technologies include flash drying and spraying. More particularly, the thermal drying is carried out at a temperature of at least 180 degrees Celsius, or at least 200 degrees Celsius, or at least 220 degrees Celsius, suitably at least 250 degrees Celsius, or at least 300 degrees Celsius. The thermal drying is carried out for between about 0.1 and about 20 seconds, suitably between about 0.1 and about 10 seconds, or between about 0.1 and about 2 seconds.

Flash drying is a well-known thermal drying method used to dry various materials, such as wood pulps, gypsum, and native starch, for example. To produce coiled or twisted fibers from a wet pulp, the pulp should be thoroughly fluffed as individual fibers prior to flash drying. For example, the fluffing device described in U.S. Pat. No. 3,987,968, herein incorporated by reference, subjects moist cellulosic pulp fibers to a combination of mechanical impact, mechanical agitation and air agitation to create a substantially knot-free fluff. To use a feed to a flash dryer, the water in the wet pulp should be removed substantially, up to about 30% to about 50% consistency by weight. This water removal is conventionally achieved by mechanical means, such as a filter press or centrifugation. At such a high consistency level, it is very difficult to fluff the pulp into individual fibers. To alleviate this problem, a mechanical device such as a disintegrator is commonly used after the mechanical de-watering step in the flash drying system.

As a drying aid, any material that speeds up the removal of water from the intra-fiber capillaries can be used. Suitable drying aids include surfactants, such as an anionic surfactant, a cationic surfactant, or a combination of an anionic surfactant, a cationic surfactant and a non-ionic surfactant. An example of a commercially available drying aid is a cationic surfactant available from Goldschmidt Chemical of Dublin, Ohio, under the trade name ADOGEN 442. Another example of a commercially available drying aid is an anionic surfactant available from Cytec Industry of Morristown, N.J., under the trade name AEROSOL OT-75. The surfactant can be added to fiber individually or in the sequence of cationic surfactant first and then anionic surfactant. In one embodiment of the invention, a never-been-dried wood pulp is treated with a drying aid, and water is removed from a pulp up to a consistency level at which the intra-fiber capillaries remain unchanged.

Optionally, the never-been-dried wood pulp can be subjected to a refining treatment to create more intra-fiber capillaries. After the fines are removed, the wood pulp can then be treated with a drying aid and then may be thermally dried.

To avoid any fluffing problems, the fluffing step, as well as the mechanical de-watering step, can be eliminated by instead drying the pulp slurry in a spray dryer until the pulp reaches a desirable consistency for subsequent thermal drying. Spray drying is another well-known thermal drying method, typically used for producing powdered products from solutions. Spray drying is generally carried out by placing the slurry or pulp into a large chamber through which a hot gas is blown, thereby removing most or all of the volatiles and enabling the recovery of the dried fibers.

Spray drying is an effective way of preparing a feed of wood pulp, and/or other hydrophilic materials, for subsequent flash drying. Spray drying is useful for preparing a feed of wood pulp, and/or other hydrophilic materials, after being chemically or mechanically modified for subsequent flash drying. A pulp slurry having a consistency as low as less than 0.1% to about 10% by weight can be dried in a spray dryer prior to thermal drying. Preparing a pulp of a desirable consistency, namely between about 15% and about 80% by weight, suitably between about 15% and about 50% by weight, for subsequent flash drying by spray drying is much more effective in fluffing the pulp into individual fibers than using conventional mechanical means.

Once the fibers have been modified according to the method of the invention, at least 80%, or at least 85%, or at least 90% of the treated fibers include fiber twists. An illustration of a twisted fiber 20 is shown in FIG. 1. As can be seen in FIG. 1, intra-fiber capillaries within the fiber twists remain intact. More particularly, fibers modified in accordance with the invention can have an average dry fiber twist count of at least about 1.5 twist nodes per millimeter, or at least about 2.0 twist nodes per millimeter, or at least about 2.5 twist nodes per millimeter, and an average wet fiber twist count of at least about 1.5 twist nodes per millimeter, or at least about 2.0 twist nodes per millimeter. Twist count can be determined using the test method described below. Futhermore, the modified fibers can maintain at least 70% of the dry fiber twist count over time after rewetting the dry fiber.

Water retention value (WRV) of the fibers may decrease slightly as a result of carrying out the method of the invention, however, the WRV should be at least 0.8 grams of water per gram of dry fiber (g/g), or at least 1.0 g/g, or at least 1.1 g/g, or between 0.8 g/g and 1.5 g/g. Several examples illustrating the formation of fiber twists and changes in WRV are provided below.

Because of their remarkable absorbency and because they are very bulky, soft, and compressible, the wood pulp or other hydrophilic fibers modified according to the present invention are particularly suitable for use in paper, tissue, towels, absorbent materials and absorbent articles, including diapers, training pants, swim wear, feminine hygiene products, incontinence products, other personal care or health care garments, including medical garments, or the like. It should be understood that the present invention is applicable to fibers used in other structures, composites, or products incorporating absorbent fibers that can be modified according to the methods of the present invention.

EXAMPLES

Example 1

Flash Drying a Rewet Southern Softwood Kraft Fiber

A dry southern softwood kraft fiber (CF 416, available from Weyerhauser Co. of Federal Way, Wash., U.S.A.) was made into a slurry and was dewatered to 15% consistency. Then the fiber was fed into a lab scale 2-inch by 2-inch Flash Dryer with 5 to 10 pounds per hour water evaporation capacity (available from Barr-Rosin Inc. of Bolsbriand, Quebec, Canada). The operations were conducted as follows:

1st stage: Inlet temperature 620 degrees Fahrenheit Outlet temperature 350 degrees Fahrenheit Outlet consistency 32.6%

2nd stage: Inlet temperature 460 degrees Fahrenheit Outlet temperature 250 degrees Fahrenheit Outlet consistency 88%

3rd stage: Inlet temperature 460 degrees Fahrenheit Outlet temperature 250 degrees Fahrenheit Outlet consistency 97.2%

The Water Retention Value (WRV) and number of fiber twists per millimeter are provided in Table 1, below.

Example 2

Flash Drying a Never-Dried Southern Softwood Kraft Fiber

A never-dried southern softwood kraft fiber (CR-54, available from Bowater Co. of Coosa Mill, Ala., U.S.A.) was made into a slurry and was dewatered to 19% consistency. Then the fiber was fed into a lab scale 2-inch by 2-inch Flash Dryer with 5 to 10 pounds per hour water evaporation capacity (available from Barr-Rosin Inc. of Bolsbriand, Quebec, Canada). The operations were conducted as follows:

1st stage: Inlet temperature 620 degrees Fahrenheit Outlet temperature 350 degrees Fahrenheit Outlet consistency 58.2%

2nd stage: Inlet temperature 460 degrees Fahrenheit Outlet temperature 250 degrees Fahrenheit Outlet consistency—not available (NA)

3rd stage: Inlet temperature 460 degrees Fahrenheit Outlet temperature 250 degrees Fahrenheit Outlet consistency 92%

The Water Retention Value (WRV) and number of fiber twists per millimeter are provided in Table 1, below.

Example 3

Spray Drying/Flash Drying a Never-Dried Southern Softwood Kraft Fiber

A never-dried southern softwood kraft fiber (CR-54, available from Bowater Co. of Coosa Mill, Ala., U.S.A.) was made into a slurry at 0.2% consistency. The slurry was treated with 0.04% Adogen (cationic surfactant) and 0.2% aerosol (anionic surfactant) sequentially. The surfactant treated fiber was fed to a spray dryer with 120 to 155 pounds per hour water evaporation capacity (available from Barr-Rosin Inc. of Bolsbriand, Quebec, Canada). The operations were conducted as follows:

Inlet temperature of 440 degrees Fahrenheit and outlet temperature of 191 degrees Fahrenheit. A wheel atomizer was operated at 17.8 K rpm with an air flow rate of 1650 ACFM. The outlet consistency was about 23%. The spray dryer partially dried fiber was fed into the flash dryer as described in Example 1 and its operation conditions were as follows:

1st stage: Inlet temperature 562 degrees Fahrenheit Outlet temperature 375 degrees Fahrenheit Outlet consistency 63%

2nd stage: Inlet temperature 431 degrees Fahrenheit Outlet temperature 371 degrees Fahrenheit Outlet consistency 95%

The Water Retention Value (WRV) and number of fiber twists per millimeter are provided in Table 1, below.

Example 4

Spray Drying/Flash Drying a Never-Dried Northern Softwood Kraft Fiber

A never-dried northern softwood kraft fiber (LL-19, available from Kimberly-Clark Corp.'s Terrace Bay Mill in Ontario, Canada) was made into a slurry at 0.2% consistency. The slurry was treated with 0.2% aerosol (anionic surfactant). The surfactant treated fiber was fed to a spray dryer with 120 to 155 pounds per hour water evaporation capacity (available from Barr-Rosin Inc. of Bolsbriand, Quebec, Canada). The operations were conducted as follows:

Inlet temperature of 440 degrees Fahrenheit and outlet temperature of 191 degrees Fahrenheit. A wheel atomizer was operated at 17.8 K rpm with an air flow rate of 1650 ACFM. The outlet consistency was about 20%. The spray dryer partially dried fiber was fed into the flash dryer as described in Example 1 and its operation conditions were as follows:

1st stage: Inlet temperature 554 degrees Fahrenheit Outlet temperature 417 degrees Fahrenheit Outlet consistency 68.5%

2nd stage: Inlet temperature 473 degrees Fahrenheit Outlet temperature 381 degrees Fahrenheit Outlet consistency 96%

The Water Retention Value (WRV) and number of fiber twists per millimeter are provided in Table 1, below.

Example 5

Spray Drying/Flash Drying a Northern Softwood Kraft Fiber and Then Re-Wetting the Fiber This example demonstrates the wetness stability of twists of the fibers from Example 4. In this example, the fibers were prepared the same way as in Example 4, except that the fibers were rewet. The rewet fibers were then dried at 105 degrees Celsius prior to testing their WRV and number of fiber twists. These test results are provided in Table 1, below. These test results demonstrate the stability of the twists after being re-wet.

Example 6

Chemical Cross-Linked and Flash Dried Fiber

In this example, chemical cross-linked and flash dried fibers were obtained from a PAMPERS diaper, manufactured by Procter & Gamble of Cincinnati, Ohio, U.S.A. The WRV and number of twists were determined and are provided in Table 1, below.

TABLE 1

Water Retention Value and Fiber Twist Data

| Example | WRV (gram water/ gram dry fiber) | Number of Twists per Millimeter | Yield (percentage of fibers with at least one twist) |
|---|---|---|---|
| 1 | 0.88 | 2.78 | NA |
| 2 | 1.28 | 4.37 | NA |
| 3 | 1.11 | 2.44 | 86.2 |
| 4 | 1.22 | 2.39 | 96.1 |
| 5 | 1.15 | 1.96 | 89.3 |
| 6 | 0.45 | 3.24 | 98 |

Twist Count Image Analysis Method

Dry fibers are placed on a slide and then covered with a cover slip. An image analyzer (Quankimet 970) comprising a computer-controlled microscope (Olympus BH2), and a video camera are used to determine twist count per millimeter fiber length.

The fiber length of a fiber within a screen field is measured by the image analyzer. The twist nodes of the same fiber are identified and counted by an operator using the microscope at 100×. This procedure is continued by selecting a fiber randomly, one fiber at a time, measuring fiber length and counting twist nodes of each of the fibers until 100 fibers randomly selected with at least one twist node are analyzed. The number of fibers without any twist nodes is also recorded. The number of twist nodes per millimeter is calculated from the data by dividing the total number of twist nodes (N) counted by the total fiber length (L) and/or can be expressed by the following equation:

$$\text{Number of twist nodes per millimeter}=N/L$$

The yield of the twist fibers is determined as follows:

$$\%\ \text{Yield}=100*(1-(Tn/(Tn+100)))$$

where Tn is the number of fibers without any twist nodes.

It will be appreciated that details of the foregoing embodiments, given for purposes of illustration, are not to be construed as limiting the scope of this invention. Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention, which is defined in the following claims and all equivalents thereto. Further, it is recognized that many embodiments may be conceived that do not achieve all of the advantages of some embodiments, particularly of the preferred embodiments, yet the absence of a particular advantage shall not be construed to necessarily mean that such an embodiment is outside the scope of the present invention.

What is claimed is:

1. A cellulosic, fibrous material comprising:

a plurality of substantially individualized, non-crosslinked, dried fibers, the fibers having an average water retention value between 0.8 and 1.5 grams water/gram dry fiber, an average dry fiber twist count of at least about 2.0 twist nodes per millimeter, an average wet fiber twist count of at least 1.5 twist nodes per millimeter, and the fibers maintain at least 70% of the dry fiber twist count after rewetting the dry fiber.

2. The cellulosic, fibrous material of claim 1, wherein the fibers have an average water retention value of at least 1.0 gram water/gram dry fiber.

3. The cellulosic, fibrous material of claim 1, wherein the fibers have an average dry fiber twist count of at least about 2.5 twist nodes per millimeter.

4. The cellulosic, fibrous material of claim 1, wherein the fibers have an average wet fiber twist count of at least about 2.0 twist nodes per millimeter.

5. The cellulosic, fibrous material of claim 1, wherein the fibers have an average water retention value of at least 1.1 gram water/gram dry fiber.

6. The cellulosic, fibrous material of claim 1, wherein at least 80% of the fibers include fiber twists.

7. The cellulosic, fibrous material of claim 1, wherein at least 85% of the fibers include fiber twists.

8. The cellulosic, fibrous material of claim 1, wherein at least 90% of the fibers include fiber twists.

9. The cellulosic, fibrous material of claim 1, wherein the fibers comprise wood pulp fibers.

10. The cellulosic, fibrous material of claim 1, wherein the fibers comprise microcrystalline cellulose.

11. The cellulosic, fibrous material of claim 1, wherein the fibers comprise microfibrillated cellulose.

12. The cellulosic, fibrous material of claim 1, wherein the material further comprises superabsorbent material.

13. The cellulosic, fibrous material of claim 1, wherein the fibers are treated with a drying aid.

14. The cellulosic, fibrous material of claim 13, wherein the drying aid comprises a surfactant.

15. The cellulosic, fibrous material of claim 14, wherein the surfactant is selected from the group consisting of an anionic surfactant, a cationic surfactant, and a combination of an anionic surfactant, a cationic surfactant, and a non-ionic surfactant.

16. Paper comprising the cellulosic, fibrous material of claim 1.

17. Tissue comprising the cellulosic, fibrous material of claim 1.

18. A towel comprising the cellulosic, fibrous material of claim 1.

19. An absorbent article comprising the cellulosic, fibrous material of claim 1.

20. The absorbent article of claim 19, wherein the absorbent article is selected from the group consisting of diapers, training pants, swim wear, feminine hygiene products, incontinence products, medical garments, and other personal care and health care garments.

* * * * *